United States Patent [19]

Robbins

[11] 4,333,556

[45] Jun. 8, 1982

[54] DEVICE FOR VARYING NUMBER OF COINS NEEDED TO PERMIT OPERATION OF A COIN-OPERATED MECHANISM

[75] Inventor: James M. Robbins, Jamestown, N.Y.

[73] Assignee: Jamestown Metal Mfg. Corp., Jamestown, N.Y.

[21] Appl. No.: 178,777

[22] Filed: Aug. 18, 1980

[51] Int. Cl.[3] ..... G07F 1/04

[52] U.S. Cl. ..... 194/92; 194/1 G

[58] Field of Search ..... 194/1 G, 92, 51, 59, 194/65

[56] References Cited

U.S. PATENT DOCUMENTS

| | | | |
|---|---|---|---|
| 2,603,335 | 7/1952 | Beimel | 194/92 |
| 3,938,640 | 2/1976 | Stackhouse et al. | 194/92 |
| 4,030,586 | 6/1977 | Etes | 194/59 |
| 4,153,150 | 5/1979 | Barth et al. | 194/92 |

*Primary Examiner*—H. Grant Skaggs

*Attorney, Agent, or Firm*—Sommer & Sommer

[57] ABSTRACT

A selector is provided for varying the number of coins needed to permit operation of a coin-operated mechanism. The mechanism has a coin chute, a key-operated rotary actuator by which the mechanism may be selectively operated, and a coin-feeling finger arranged to permit operation of the actuator when a coin is sensed as being in a predetermined position within the coin chute. The selector includes an intermediately-pivoted operating arm mounted on the coin chute and having a nose portion engaging a cam on the actuator. A selector lever is pivotally mounted on the arm and may be moved to any of three discrete positions relative thereto. The arm carries two stops which are moved to coin-holding or out-of-the-way positions at each of the three relative positions. By selectively adjusting the position of the selector lever relative to the arm, the mechanism may be adjusted to require deposit of one, two or three coins before the mechanism may be operated.

17 Claims, 6 Drawing Figures

10
12
15
18
22
23
24
25
35
38
39
40
41
43
44
45
46
47
48
49
50
50'
50"

DEVICE FOR VARYING NUMBER OF COINS NEEDED TO PERMIT OPERATION OF A COIN-OPERATED MECHANISM

BACKGROUND OF THE INVENTION

1. Field of the Invention

The present invention relates generally to the field of coin-operated mechanisms, and more particularly to an improved selector which may be adjusted to vary the number of coins needed to operate the mechanism.

2. Description of the Prior Art

Many types of coin-operated mechanisms have been heretofore developed. One species of such mechanisms is the coin-operated lock, frequently found in lockers in bus and train stations, airports and the like.

U.S. Pat. No. 2,806,573 discloses a coin-operated mechanism wherein the coin chute is provided with an intermediate exit window through which undersized coins are inertially thrown.

U.S. Pat. Nos. 3,228,506 and 3,599,770 disclose a coin-operated locks, each having a coin-feeling finger, a rotatable patron lock, and an intermediately-pivoted operating arm movable in response to rotation of the patron lock. These references also disclose a coin-intercepting finger pivotally mounted on the operating arm, the position of which may be adjusted to vary the size or denomination of a single coin needed to operate the mechanism.

U.S. Pat. No. 3,938,640 discloses a coin-operated lock wherein a complicated operating arm may be selectively adjusted to vary either the denomination or number of coins, or both, needed to permit operation of the lock.

Other forms of coin-operated locks requiring insertion of multiple coins as a condition precedent to operation, are shown in the following U.S. Pat. Nos.: 3,077,970; 2,603,335; 2,649,949; 2,634,848; 4,153,150; and 4,131,191.

SUMMARY OF THE INVENTION

The present invention provides a selector for varying the number of coins needed to permit operation of a coin-operated mechanism, such as a lock.

The coin-operated mechanism includes a coin chute, an actuator by which the mechanism may be selectively operated, and a coin-feeling finger arranged to permit operation of the actuator when a coin is sensed as being in a predetermined position within the coin chute.

The selector includes an arm mounted for movement relative to the chute, the arm having one portion engageable with the actuator; a first stop mounted on the arm and selectively movable relative thereto between an operable position arranged to hold a coin within the chute in a first position to be sensed by the finger, and an inoperable position which will permit a coin to pass; a second stop mounted on the arm and selectively movable relative thereto between an operable position arranged to hold a coin within the chute in a second position beneath the first position, and an inoperable position which will permit a coin to pass; and a third stop mounted on the arm and arranged for movement therewith between an operable position at which a coin within the chute will be held in a third position beneath the second position, and an inoperable position which will permit a coin to pass; whereby the first and second stops may be selectively moved relative to the arm to vary the number of coins needed to permit the actuator to be operated.

Accordingly, the general object of the present invention is to provide an improvement in a coin-operated mechanism, which may be easily adjusted to vary the number of coins needed to permit operation of said mechanism.

Another object is to provide an improved coin-operated mechanism which minimizes structural complexity, and is easy to adjust and maintain.

These and other like objects and advantages will become apparent from the foregoing and ongoing specification, the drawings, and the appended claims.

DESCRIPTION OF THE PREFERRED EMBODIMENTS

Figure 2:
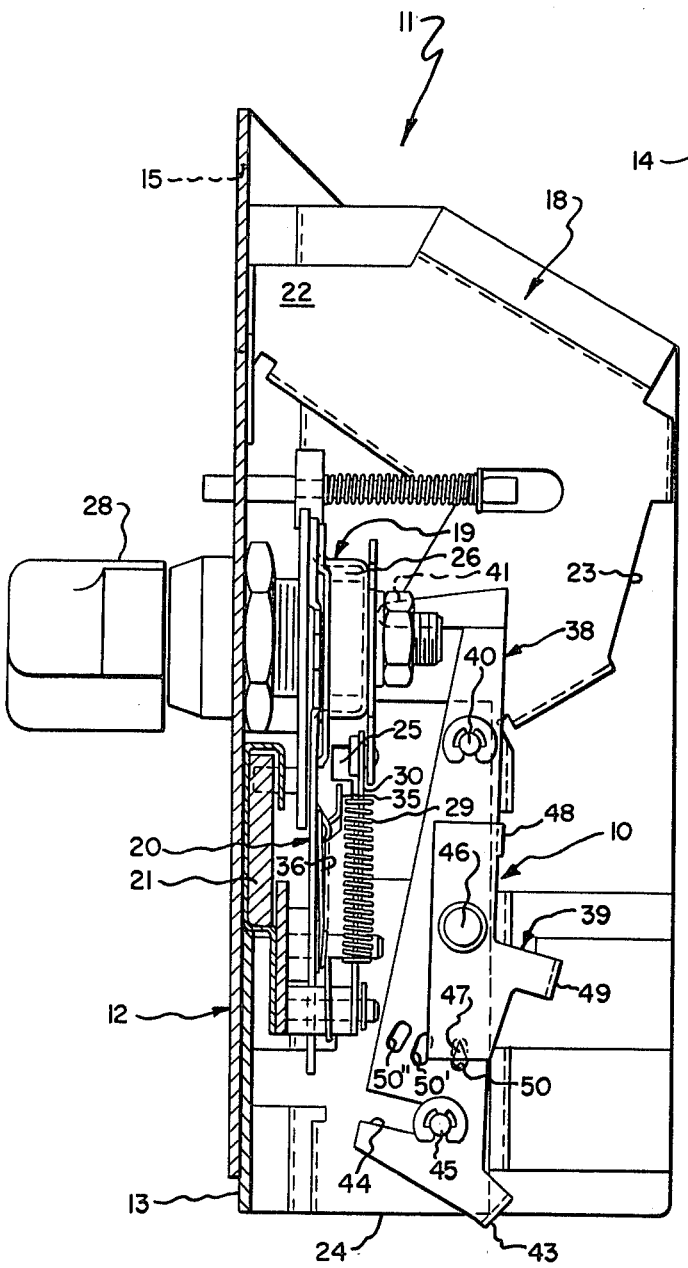
FIG. 2 is a fragmentary transverse vertical sectional view thereof, taken generally on line 2—2 of FIG. 1, and principally showing the patron lock and the selector in side elevation.

At the outset, it should be clearly understood that like reference numerals are intended to identify the same elements and/or structure consistently throughout the several drawing figures, as such elements and/or structure may be further described or explained by the entire written specification, of which this detailed description is an integral part.

Figure 1:
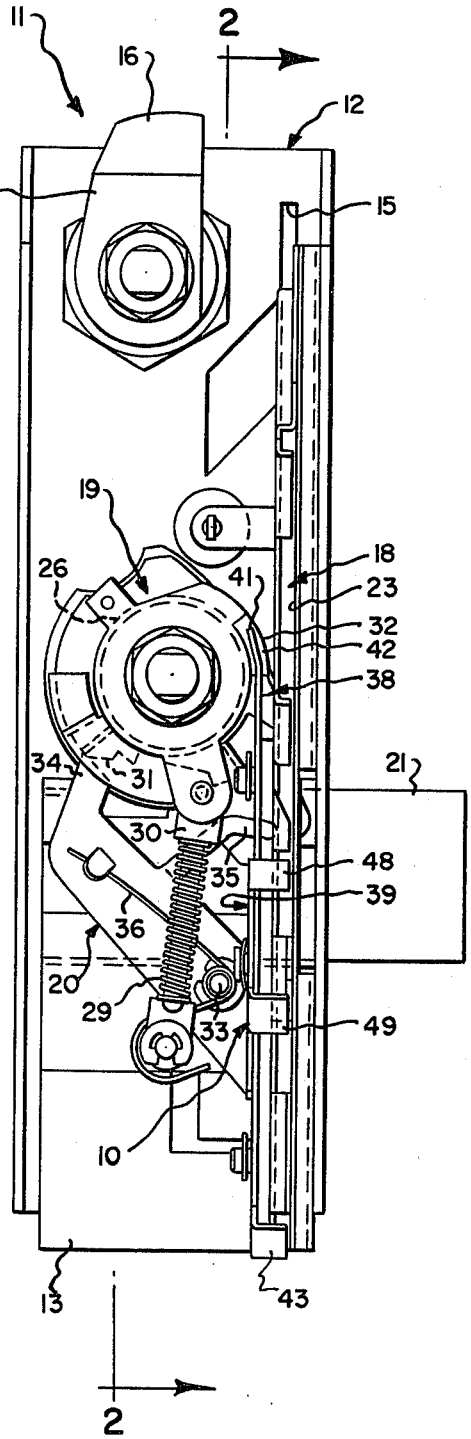
FIG. 1 is a rear elevation of a coin-operated lock mechanism incorporating the improved selector.

Referring now to the drawings, and more particularly to FIGS. 1 and 2 thereof, the invention provides a selector mechanism, of which the presently preferred embodiment is generally indicated at 10, for varying the number of coins needed to operate a coin-operated mechanism, such as lock 11.

Coin-Operated Mechanism 11

The coin-operated mechanism 11 shown in FIGS. 1 and 2 is adapted to be mounted on the jamb of a locker (not shown), frequently found in bus station, airports, and the like.

Inasmuch as the basic structure of mechanism 11 is well known, the ensuing description thereof will be somewhat abbreviated in order that the reader may focus on the specific improvement provided by applicant. Such basic lock structure, and its operation, is more fully shown and described in U.S. Pat. Nos. 3,599,770, 3,228,506, and 3,938,640.

Coin-operated mechanism 11 is shown as including a face plate 12 adapted to be removably mounted on the jamb of a locker. Face plate 12 has mounted thereon a lower mounting lip 13, an upper custodial lock 14, and a coin slot 15. The custodial lock 14 includes a locking cam 16 which may be selectively rotated by means of a custodian-controlled key (not shown), to engage the jamb of the locker. Hence, the entire coin-operated mechanism 11 may be removably mounted on a locker jamb.

The main elements of the mechanism 11 are a coin chute 18, a patron-lock 19, a feeler arm 20, and a throw bolt 21.

The coin chute 18 is a specially-configured member formed from an appropriate blank having portions thereof bent appropriately to provide an internal zig-zag salient channel through which a coin will descend. The width of this channel is only slightly greater than the thickness of a desired coin. The various walls of the channel are spaced from one another by distances only slightly greater than the diameter of the coin. The coin channel has an upper entrance opening 22 adapted to receive a coin passing through coin slot 15, an intermediate exit opening 23 communicating with either a coin box (not shown) or a coin return slot (not shown), and a lower discharge opening 24 beneath which a coin box is positioned. The coin slot 15, or some restricted member (not shown) associated therewith, is configured to deny admission to oversized coins. Hence, only coins of the desired denomination and undersized coins may pass through the coin slot 15 to enter the channel. The coin channel has a downwardly and rightwardly inclined upper portion, arranged between entrance opening 22 and exit opening 23, an intermediate portion continuing downwardly and leftwardly from exit opening 23, and a lower portion continuing downwardly therefrom and terminating in discharge opening 24. The exit opening 23 is configured so as to retain coins of the desired denomination, but to allow undersized coins to pass therethrough. The walls of the coin channel upper portion are inclined so as to direct the descent of a coin toward the exit opening. Hence, an undersized coin descending along the channel upper portion will be inertially thrown through the exit opening 23, while coins of the desired denomination will be constrained to continue to descend downwardly through the channel lower portion toward discharge opening 24. The coin chute is shown as being further provided with a lateral opening or window 25 (FIG. 2).

The patron lock 19 is mounted on the face plate, and has a rotatable barrel 26. An operator may upon deposit of the requisite number of coins, close the locker door and rotate the barrel by turning the key in the appropriate direction to extend throw bolt 21. A compression spring 29 is mounted on the face plate and engages an arm 30 extending radially outwardly from the barrel to bias the throw bolt toward either extreme position. This is a type of over-center mechanism which urges the throw bolt towards either of its fully extended position or its fully retracted position. A ratchet-like member 31 and an operating cam member 32 are mounted on the patron lock barrel 26 for movement therewith.

The feeler arm 20 is an F-shaped member mounted on the face plate for rotation about pivot point 33. The upper end of this feeler is configured as a pawl 34 and is arranged to engage the ratchet-like member 31. The other end of the feeler is configured as a coin-feeling finger 35 arranged to penetrate coin chute window 25 to sense the presence of a coin at a certain position within the coin chute. A spring 36 biases the feeler arm in a clockwise direction (FIG. 1), such that its pawl 34 will move into engagement with ratchet-like member 31, and its coin-feeling finger 35 will move toward the window 25. When the ratchet and pawl are so engaged, the operator may not rotate the patron lock barrel in the appropriate direction. However, when a coin is in the desired position within the coin chute so as to displace finger 35, the pawl will be displaced away from ratchet-like member 31, thereby permitting selective rotation of the patron lock barrel.

Selector Mechanism 10

The present invention provides a selector mechanism 10 which may be selectively adjusted to vary the number of coins of like denomination needed to permit such operation of mechanism 11.

As best shown in FIG. 2, the selector mechanism broadly includes an operating arm, generally indicated at 38, pivotally mounted on the coin chute, and a selector lever, generally indicated at 39, pivotally mounted on the operating arm.

The operating arm 38 is shown as being mounted for rotation about intermediate pivot point 40. Arm 38 has an uppermost pointed nose 41 arranged to engage the inclined surface 42 of barrel cam 32, and has a lowermost transverse stop 43 which is adapted to hold a properly-sized coin in a lowermost position within the coin chute when the selector is set for three-coin operation. Adjacent its lower end, the arm is provided with an arcuate slot 44 so as to permit pivotal motion of the arm relative to a stationary guide post 45.

The selector lever 39 is mounted on the operating arm for relative rotation about intermediate pivot point 46. Lever 39 may be rotated in one direction (counterclockwise in FIG. 2) to cause an uppermost transverse stop 48 to pass through a recess provided in the chute and to enter the coin channel to hold a coin in an uppermost first position relative to the coin chute. Alternatively, lever 39 may be rotated in the opposite relative direction (clockwise in FIG. 2) to move stop 48 to an out-of-the-way position, and to cause an intermediate transverse stop 49 to enter a recess provided in the coin chute to hold a coin in an intermediate second position relative to the coin chute.

Figures 3, 4, 5, 6:
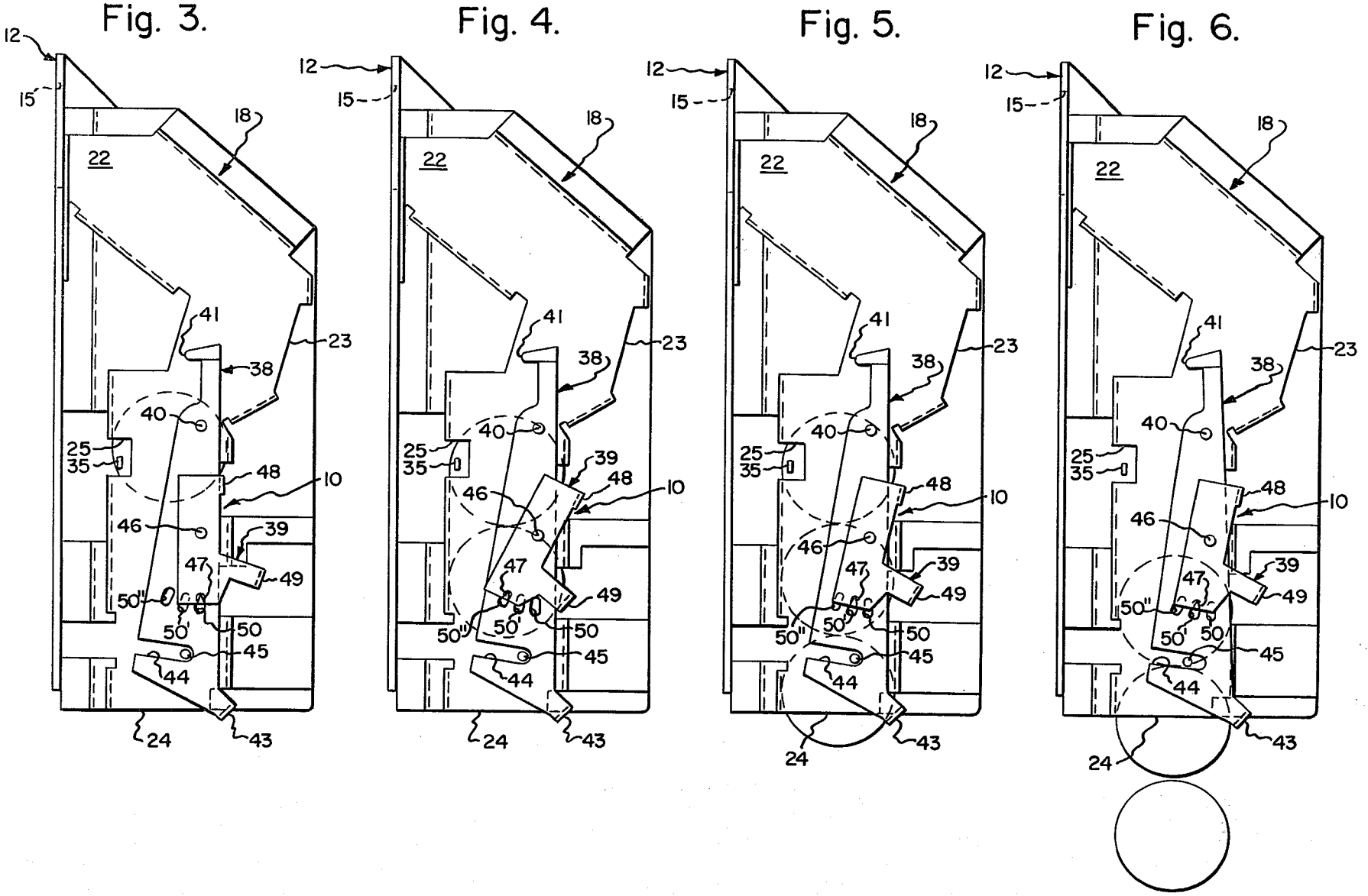
FIG. 3 is a fragmentary side elevation of the coin chute and selector, showing the selector as adjusted to permit operation by one coin and with single coin deposited therein.
FIG. 4 is a fragmentary side elevation of the coin chute and selector, showing the selector as adjusted to permit operation by two coins and with two coins deposited therein.
FIG. 5 is a fragmentary side elevation of the coin chute and selector, showing the selector as adjusted to permit operation by three coins, and with three coins deposited therein.
FIG. 6 is a view similar to FIG. 5, but showing the position of the selector as permitting the three coins to fall after the actuator has been operated.

The lever 39 is provided with a suitable detent 47 which is engageable with any of three recesses, 50, 50' and 50'' provided on the arm. When the detent is in recess 50 (FIGS. 2–3), the lever's upper stop 48 is in its operative position to hold a coin in an upper first position relative to the coin chute. When the detent is in recess 50'' (FIG. 4), the lever's upper stop 48 is in its inoperative out-of-the-way position, and the lever's lower stop 49 is in its operative position to hold a coin in an intermediate second position relative to the coin chute. In this position, a second deposited coin will rest in edge contact upon the coin held by the lower stop in the second position, and such upper coin will be in a position to be felt by the finger 35. Alternatively, the lever may be moved to a position such that the detent will engage middle recess 50' (FIGS. 5 and 6). This represents a neutral position of the lever relative to the arm, at which position both the upper and lower stops will be in out-of-the-way inoperative positions. In this neutral position, a deposited first coin may descend through the chute's lower portion, to be held by arm stop 43 in a lowermost third position. If two desired coins are subsequently deposited, these will rest on the first coin, with the last deposited coin being held within the coin chute at a position to be felt by the feeling finger 35.

Operation

The operational modes of the improved selector 10 are comparatively illustrated in FIGS. 3–6.

As previously indicated the nose 41 of operating arm 38 engages the cam surface 42 rotatable with the barrel of the patron lock. The patron lock cannot normally be rotated because of the operative engagement of feeler pawl 34 with the ratchet-like member 31 mounted fast to the patron lock barrel. However, when a coin is held within the coin chute so as to be felt by finger 35, the feeler arm 20 will be displaced (counterclockwise in FIG. 1), thereby disengaging pawl 34 from ratchet-like member 31 and permitting the patron to selectively rotate the barrel and cam of the patron lock. However, to permit such operation, the patron must first deposit the required number of coins.

In FIG. 3, the selector detent is engaged with operating arm recess 50, so that the selector's first stop 48 will be in its operative coin-holding position. This represents the single coin mode. The operative position of the first stop 48 is arranged such that the feeling finger 35 will sense the presence of a coin through window 25. Thereafter, the patron may selectively operate the patron lock. As this occurs, the the operating arm 38 will rotate (counterclockwise in FIG. 3) about pivot point 40. Such rotation will move the upper stop 48 (and arm stop 43) away from the coin chute, until ultimately the coin drops through to the coin box.

In FIG. 4, the selector detent is engaged with operating arm recess 50'', so that the first stop 48 will be in an inoperative out-of-the-way position. However, the second stop 49 has now entered the channel so as to retain a coin in a second position relative to coin chute. Until two coins are deposited, the feeler arm will prevent rotation of the patron lock. When a first coin is deposited, it quickly passes by the feeling finger 35 and is held by second stop 49 in a second position relative to the coin chute. Once the first deposited coin is in this position, the lock may not be operated because the feeling finger 35 will not sense a coin through window 25. Hence, a second coin must be deposited. This will descend through the chute and rest in edge contact upon the first deposited coin, in a position to be sensed by feeling finger 35. When the second-deposited coin is so sensed, the feeler pawl 34 will be disengaged, and the patron may selectively rotate the patron lock. Again, such rotation will move the operating arm 38 counterclockwise, with the second stop moving away from the coin chute, until ultimately both coins drop through to the coin box. When the patron key is rotated in the opposite angular direction, the operating arm will move back (clockwise) to its original position.

The selector may be adjusted for three-coin operation by moving the selector lever until the detent snaps into middle recess 50'. (FIG. 5) This represents the neutral position of the selector lever relative to the operating arm, at which both the first and second stops 48, 49 will be in out-of-the-way positions. A first-deposited coin will descend through the chute and be held in a lowermost third position by the fixed stop 43 on the operating arm. A second-deposited coin will rest in edge contact upon the first coin, at an intermediate position within the chute. This intermediate position is beneath feeling finger 35, and the patron lock will still be non-rotatable. A third-deposited coin will descend through the chute and rest in edge contact upon the second-deposited coin, in an upper or third position relative to the coin chute. The feeling finger will be displaced by the presence of the third coin, thereby disengaging the pawl from the ratchet and permitting selective rotation of the patron lock. Such operation will pivot the operating arm counterclockwise about pivot point 40, moving stop 43 toward an out-of-the-way position, until ultimately all three coins drop into the coin chute (FIG. 6). Upon reverse rotation of the patron lock, the operating arm will move from the position shown in FIG. 6 back to the reset position shown in FIG. 5.

Therefore, the present invention provides a unique selector which may be quickly and easily adjusted to vary the number of coins needed to operate a coin-operated mechanism.

As used herein, the term "coin" is intended generically to include conventional coins, tokens, and the like. The mechanism, and the improved selector, may be readily adapted to handle coins of different denominations and sizes. The coin chute may be readily varried, as desired. The operating arm need not be invariably mounted for pivotal movement, although this configuration is presently preferred. The first and second stops may be individually mounted on the operating arm for selective movement independently of one another, and need not be pivotally movable relative to the operating arm. The improved selector is not limited to use with the particular type of coin chute herein disclosed, but may be used with other coin chutes as well. The detent and recess is only one of many possible ways to prevent relative movement between the selector lever and the operating arm. In the disclosed embodiment, the intermediate coin position is nominally located one coin diameter beneath the upper coin position, and the lowermost coin position is nominally located two diameters beneath such upper coin position. The uppermost coin position is arranged such that the feeling finger will sense the presence of a coin through the window. The operating arm is shown as being intermediately povoted, with the nose on one side of such pivotal axis and the stops on the other, although this arrangement may also be varied. While the simplicity of the coin chute and selector are felt desirable, the structure of these devices may be more structurally encumbered. For example, if the improved selector were employed with another type of coin chute which did not separate undersized coins, the various stops could conceivably be made further adjustable so as to accommodate different coin denominations.

The term "coin-operated mechanism" is intended generically to include coin-operated locks of the type disclosed, and other coin-operated mechanisms as well. The "coin-feeling finger" is also intended in a generic sense. While the patron lock is a type of rotary actuator, the term "actuator" is broadly intended to include other types of actuators, which need not necessarily be rotatable. While it is desired that the operating arm be moved by the actuator, the connection therebetween may be either direct (as shown) or indirect. It may also be possible to provide additional stops so as to adapt the apparatus to handle more than three coins, if so desired.

Therefore, while the presently preferred embodiment has been shown and described, and several modifications thereof discussed, persons skilled in this art will readily appreciate that various additional changes and modifications may be made without departing from the spirit of the invention, as defined by the following claims.

What is claimed is:

1. In a coin-operated mechanism having a coin chute, an actuator by which said mechanism may be selectively operated, and a coin-feeling finger arranged to permit operation of said actuator when a coin is sensed as being in a predetermined position within said chute, the improvement comprising: a selector for varying the number of coins needed to permit said actuator to be operated, said selector mechanism including an arm mounted for movement relative to said chute, said arm having one portion engageable with said actuator;

a first stop mounted on said arm and selectively movable relative thereto between an operable position arranged to hold a coin within said chute in a first position to be sensed by said finger, and an inoperable position which will permit a coin to pass;

a second stop mounted on said arm and selectively movable relative thereto between an operable position arranged to hold a coin within said chute in a second position beneath said first position, and an inoperable position which will permit a coin to pass; and a third stop mounted on said arm and arranged for movement therewith between an operable position at which a coin within said chute will be held in a third position beneath said second position, and an inoperable position which will permit a coin to pass;

whereby said first and second stops may be selectively moved relative to said arm to vary the number of coins needed to permit said actuator to be operated.

2. The improvement as set forth in claim 1 wherein said coin-operated mechanism is arranged to be operated by one coin when said first stop is in said operable position.

3. The improvement as set forth in claim 1 wherein said coin-operated mechanism is arranged to be operated by two coins when said first stop is in said inoperable position and said second stop is in said operable position.

4. The improvement as set forth in claim 1 wherein said coin-operated mechanism is arranged to be operated by three coins when said first and second stops are in said inoperable positions.

5. The improvement as set forth in claim 1 wherein said arm is pivoted at a point intermediate its longitudinal extent, and said one portion of said arm is arranged on one side of such pivot point.

6. The improvement as set forth in claim 5 wherein said first stop is arranged on the other side of such pivot point.

7. The improvement as set forth in claim 5 wherein said second stop is arranged on the other side of said pivot point.

8. The improvement as set forth in claim 5 wherein said third stop is arranged on the other side of said pivot point.

9. The improvement as set forth in claim 1 wherein said first stop is pivotally mounted on said arm.

10. The improvement as set forth in claim 1 wherein said second stop is pivotally mounted on said arm.

11. The improvement as set forth in claim 1 wherein said third stop is mounted fast to said arm.

12. The improvement as set forth in claim 1 and further comprising a selector lever pivotally mounted on said arm, and wherein one portion of said lever provides said first stop and another portion of said lever provides said second stop.

13. The improvement as set forth in claim 12 and further comprising detent-and-recess means operatively arranged between said lever and arm for preventing unintended relative movement therebetween.

14. The improvement as set forth in claim 1 wherein the nominal center of said second position is spaced from the nominal center of said first position by at least one diameter of said coin.

15. The improvement as set forth in claim 1 wherein the nominal center of said third position is spaced from the nominal center of said second position by at least one diameter of said coin.

16. The improvement as set forth in claim 1 wherein the nominal center of said third position is spaced from the nominal center of said first position by at least two diameters of said coin.

17. The improvement as set forth in claim 1 wherein said coin chute has an entrance opening sized to prevent admission of coins physically larger than the denomination desired to operate said coin-operated mechanism, has an exit opening sized to retain coins of said desired denomination but to pass coins which are physically smaller than said desired denomination, and wherein a portion of said chute is inclined such that such smaller coins will inertially pass through said exit opening.

* * * * *